United States Patent [19]

Boujet et al.

[11] 4,210,880

[45] Jul. 1, 1980

[54] MULTIPLE BRANCH-LINE WAVE GUIDE COUPLER

[75] Inventors: Jean-Pierre Boujet, Chatillon; Jean Dietz, Villejuif, both of France

[73] Assignee: Compagnie Industrielle des Telecommunications Cit-Alcatel, Paris, France

[21] Appl. No.: 942,258

[22] Filed: Sep. 14, 1978

[30] Foreign Application Priority Data

Oct. 7, 1977 [FR] France ..... 77 30274

[51] Int. Cl.[2] ..... H01P 1/20; H01P 5/18

[52] U.S. Cl. ..... 333/110; 333/113

[58] Field of Search ..... 333/113, 126, 135, 110

[56] References Cited

U.S. PATENT DOCUMENTS 3,529,205 9/1970 Miller ..... 333/113 X

*Primary Examiner*—Paul L. Gensler

*Attorney, Agent, or Firm*—Sughrue, Rothwell, Mion, Zinn & Macpeak

[57] ABSTRACT

Two main rectangular wave guides e.g. for telecommunications in GHz frequency bands are coupled by arms inclined for example at 60°. This simultaneously simplifies machining of the coupler in the form of two symmetrical shells and also improves the electrical characteristics of the coupler.

5 Claims, 7 Drawing Figures

MULTIPLE BRANCH-LINE WAVE GUIDE COUPLER

FIELD OF THE INVENTION

The invention relates to a multiple branch-line wave guide coupler. Such a coupler is used to couple two rectangular wave guides which conduct electromagnetic waves in the hyperfrequency range.

BACKGROUND OF THE INVENTION

Conventional multiple branch-line couplers have been known for a long time.

The book by Montgomery (Montgomery Collection MIT, volume 2, pages 897 to 905) describes a coupler of this type with two coupling arms 2 and 4 which connect two parallel main wave guides 6 and 8, each having a width a and depth b (see FIG. 1).

Later, in 1958, Reed calculated "The multiple branch-line wave guide coupler", using Chebyshev polynomials (I.R.E. TRANS M.T.T., (pages 398 to 403) October, 1958, John Reed). One variant of this coupler is also discussed in an article entitled "Synchronous branch-line coupler" by Matthei at pages 819 to 841 of the book "Microwave filters and coupling" published by McGraw Hill.

In both these cases, two rectangular (TE 10 mode) wave guides are coupled together by E plane T-connections.

The coupling arms are perpendicular to the main wave guides.

The length of each of the coupling arms and the spacing between the axes of the arms is close to $\lambda g/4$; where $\lambda g$ is the average length of the guided wave in the frequency band to be transmitted.

The number of coupling arms required in a given frequency band is a function of the value of the coupling required, the acceptable standing wave ratio (SWR) and the required directivity.

These couplers are conventionally constituted by two metal shells assembled in a junction plane which passes through the centres of the large sides of the main wave guides and of the wave guides which form the coupling arms. These two shells are formed from two machined blocks hollowed out from this junction plane to form the main wave guides and the coupling arms. More precisely a half first main wave guide and a half second main wave guide parallel to the first and having the same width b and depth a/2 are initially formed in each of these blocks, and then a plurality of half coupling arms are formed parallel to one another and having the same length $\lambda g/4$. The two shells are then assembled so as to place the main half wave guides opposite one another and the half coupling arms opposite one another.

To obtain high electric performance and in particular low passive or linear losses, it is necessary for the junction plane in a TE 10 mode rectangular wave guide to pass through the centres of the large sides of the main wave guides and of the wave guides which form the coupling arms, i.e. through the centre lines of the large surfaces. Indeed, since there is no longitudinal electromagnetic current in the vicinity of these centre lines perfect mechanical and electrical contact between the two blocks can therefore be avoided without disadvantage.

This is why technicians who produce couplers of this type form them from two shells; this realization is all the more desirable as numerous hyperfrequency components must be integrated in the same metal assembly which can then be completely made of two shells after suitable machining.

In the field of hyperfrequencies whose spectrum lies between one GHz and several hundreds of GHz, numerous machining methods can be used, but at 10 GHz and above, the half coupling arms are not easy to produce because of the small dimensions of the main wave guides. The following methods can be used:

electro-erosion to form the coupling arms perpendicularly to the main wave guides. The large thickness of the wall does not make it possible to obtain good reproductibility by this method.

use of a multi-blade plane for cutting out the coupling arms. This method is mechanically accurate but the tooling is expensive. It takes a long time to adjust tooling and to machine properly.

Preferred embodiments of the present invention provide couplers for multiple branch-line wave guides which have small dimensions and a wide frequency band, a low standing wave ratio and high directivity, using a very simple machining method and standard tooling, the machining time being very short.

SUMMARY OF THE INVENTION

In particular, the present invention provides a multiple branch-line wave guide comprising:

a first main wave guide having a rectangular cross-section with two large surfaces along two large sides of the cross-section and two small surfaces along two small sides;

a second main wave guide of the same type as the first, extending at a distance from the first and parallel thereto with a large surface facing a large surface of the first; and a plurality of coupling arms in the form of wave guides with rectangular cross-sections each with a large side parallel and substantially coextensive with the large sides of the cross-sections of the main wave guides, these arms extending parallel to each other between the two large surfaces which face each other of the two large surfaces of the two main wave guides and opening out at both their ends into the two main wave guides to couple these two wave guides together;

the improvement wherein the coupling arms extend in a direction which forms an angle (A) of less than 90° with the direction of the main wave guides.

The angle (A) lies preferably between 25° and 50°.

The coupler can advantageously be, constituted by two conductive shells assembled along a junction plane which passes through the centres of the large sides of the main wave guides and of the wave guides which form the coupling arms, these two shells being hollowed out from the junction plane to form the main wave guides and the coupling arms, each of these shells comprising:

a first half main wave guide;

a second half main wave guide parallel to the first and having the same width (b) and depth (a/2); and a plurality of half coupling arms parallel to one another having the same length (k) and forming said angle (A) with the half main arm wave guides.

The sine of this angle (A) is less than the expression $2b/(a-k)$.

The choice of the angle (A) allows easy machining of the half coupling arms by means of a circular slitting saw whose axis of rotation is parallel to the junction plane, and is situated above this plane and perpendicular to the half coupling arms, and there is no danger that the slitting saw will machine simultaneously both large surfaces of each of the two half main waves guides.

The present invention also provides a diplexer constituted by two half-energy couplers as defined above together with a pair of frequency filters which are disposed on the main wave guides and are relatively shifted in the same direction as are the openings of the arms by an amount lying between 50% and 100% the shift of the openings.

A method of using the invention will be described by way of a non-limiting example with reference to schematic FIGS. 1 to 7 of the accompanying drawings.

Components which correspond to each other in several of these figures are designated therein by the same reference symbols.

DESCRIPTION OF PREFERRED EMBODIMENTS

Figure 1:
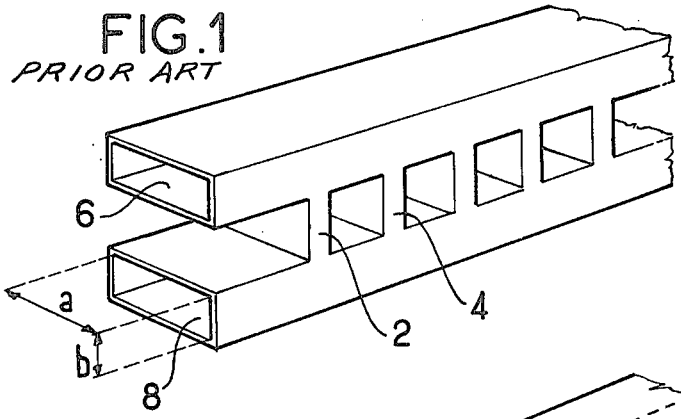
FIG. 1 PRIOR ART
FIG. 1 is a perspective view of a multiple branch-line wave guide coupler of known type and shows the position of the large sides (a) and small sides (b) of the rectangular cross-section of the main wave guides.
Figure 2:
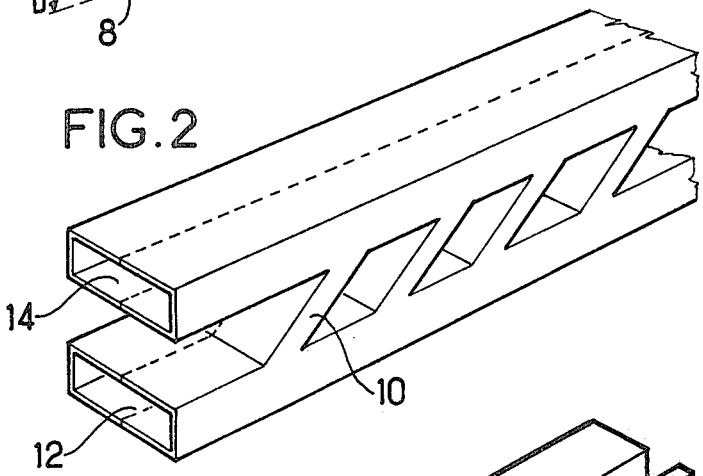
FIG. 2 is a perspective view of a coupler in accordance with the invention.
Figure 3:
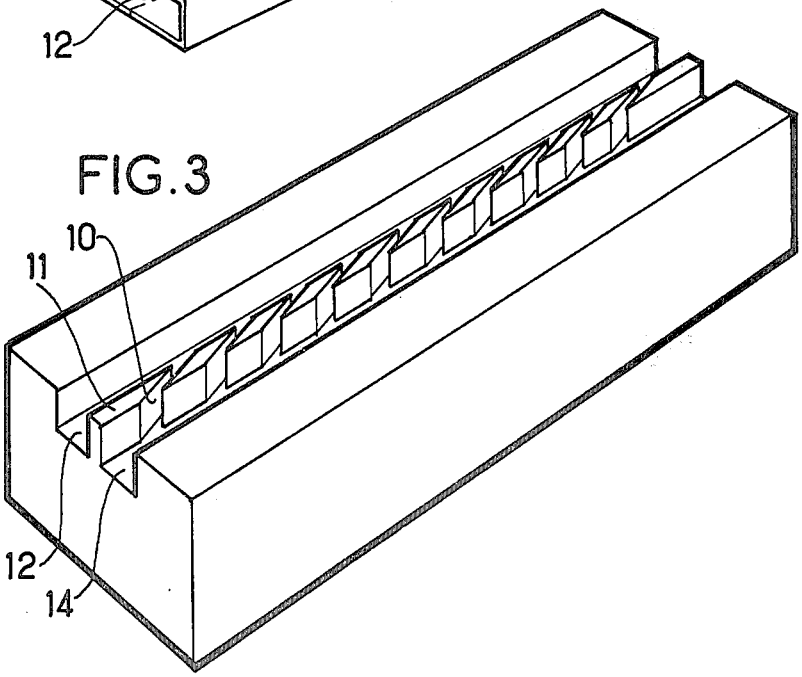
FIG. 3 is a perspective view of a conductive shell hollowed out from the junction plane to allow a coupler in accordance with the invention to be constituted by assembly with another shell which is symmetrical to the one shown about the junction plane.

The coupler in accordance with the invention shown in FIG. 2 is a variant of the conventional multiple branch-line rectangular wave guide coupler. It differs in that the coupling arms are greatly inclined (45°, 60° or more) in relation to conventional T-shaped coupling arms, which would be perpendicular to the main wave guides 12 and 14. The discontinuous line in FIG. 2 represents the junction plane of two half-shells.

Two versions of the coupler have been produced:

one with A=45° and 3 dB coupling and the other with A=30° and 3 dB coupling.

The stray capacitance and inductance seem to be lower than in a conventional multiple branch-line coupler and electric performance is therefore very high.

Further, the inclination of the coupling arms allows simple and rapid production. Corresponding points of the openings of the arms in each of the long sides of the wave guides are staggered by $\lambda g/4$, while the arms are a little shorter than $\lambda g/4$; due to the inclination of the arms, a relatively thin wall 11 (FIGS. 4 and 5) can be used between the two main wave guides 12 and 14 and the greater the inclination, i.e. the smaller the angle A, the thinner the wall will be. This characteristic is advantageous, especially at low frequencies of the hyperfrequency spectrum, when it is required to reduce weight and volume. The thickness is approximately $0.23\lambda g$ Sin A.

In particular, a 3 dB hybrid coupler has been produced for a frequency band of 31 to 48 GHz. Sides (a) and (b) of the main wave guides were:

a=7.112 mm, and b=3.556 mm.

The bandwidth of this frequency band is wide: about 40% as far as concerns the length of the guided wave. For the directive coupler to have a standing wave ratio of less than 1.05, eight coupling arms are necessary. The angle of inclination of the arms is 60°, i.e. A=30°.

One particularity appears in this type of coupler: the phase planes at the outputs of two main wave guides are shifted in proportion with the inclination of the coupling arms.

Whatever the coupling value may be, such a coupler is machined simply and rapidly with standard tooling. This is particularly important in the hyperfrequency spectrum of 10 GHz to 100 GHz and more where wave guides are very small.

To form this coupler with inclined arms, standard slitting saws are used, e.g. a slitting saw with a diameter of 20 mm for a coupler in a $WR_{28}$ wave guide in which:

a=7.112 mm, and b=3.556 mm.

Figure 4:
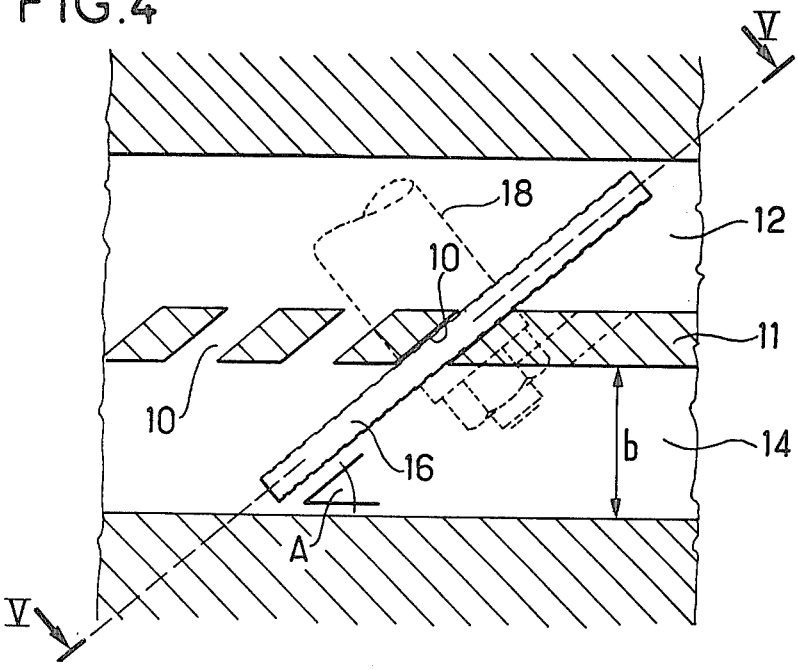
FIGS. 4 and 5 are cross-sectional views of the shell of FIG. 3 through planes IV—IV and V—V parallel to the junction plane and perpendicular to the plane which passes through the axis of a half coupling arm; p
Figure 5:
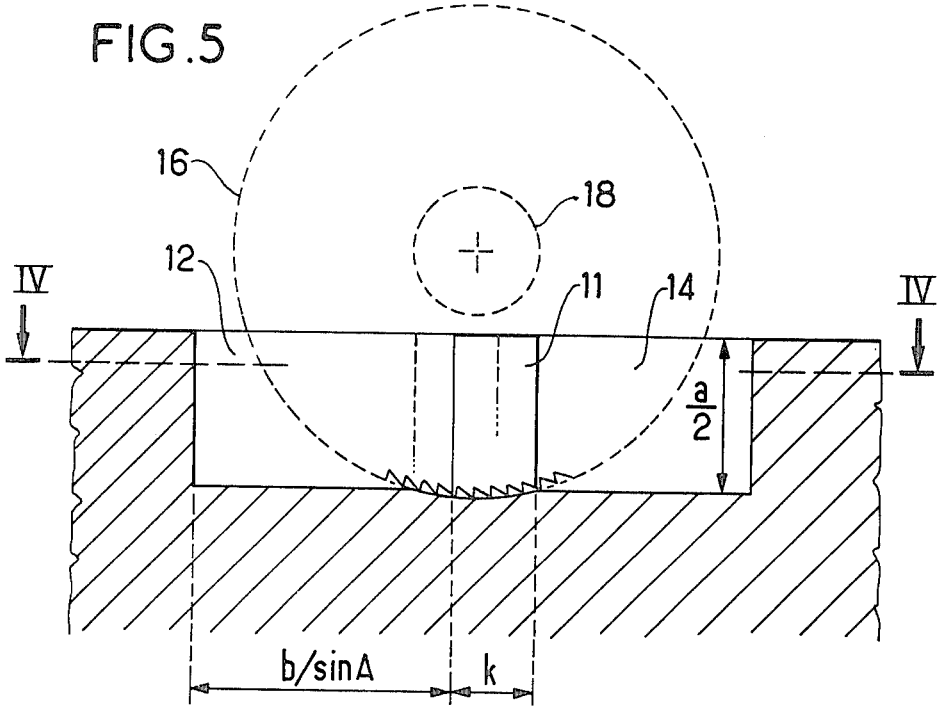

FIGS. 4 and 5 show the position of the slitting saw 16 during machining of a coupling arm 10.

It is observed that, due to the inclination, only the central wall is machined.

In the case of a conventional multiple branch-line coupler, such machining is not possible even with special small slitting saws.

It is also observed that the axle 18 of the saw can have a large diameter for precision machining.

A standard high-precision milling machine with a machining time of less than 30 minutes can be used for machining a mass-produced coupler.

FIG. 5 shows clearly that with the axle 18 situated above the junction plane while a shell is being machined Sin A must be less than $2b/(a-k)$ to allow the half coupling arms to be machined from one end to the other without touching the large surfaces of the main wave guides 12 and 14 opposite to the middle wall 11. In fact, Sin A must be substantially less than this value if it is required to use a large-diameter axle 18 situated entirely above the junction plane.

Figure 6:
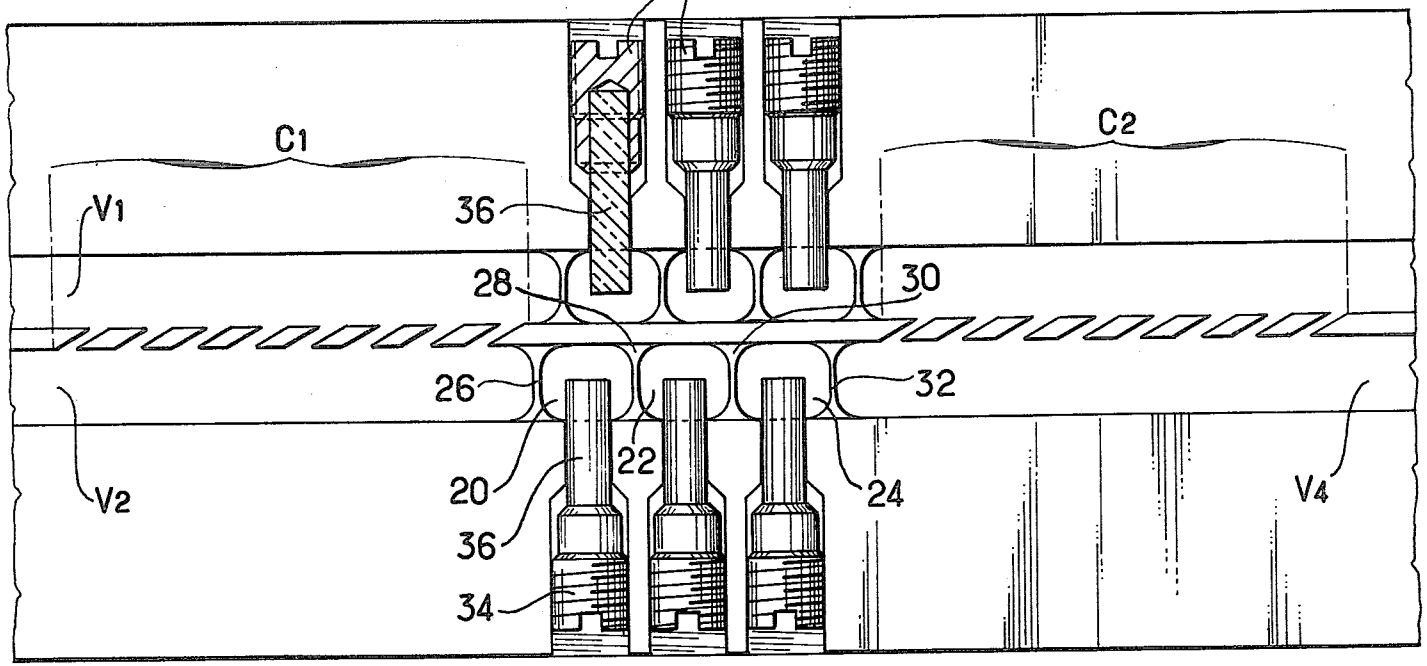
FIG. 6 is a plan view of a shell which allows a diplexer to be produced by means of the invention.
Figure 7:
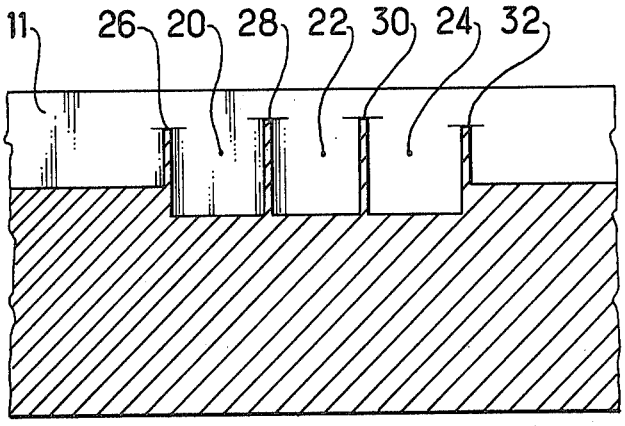
FIG. 7 is a cross-sectional of this same shell through a plane perpendicular to that of FIG. 6 and passing through the axis of a main wave guide.

FIGS. 6 and 7 show the application of two −3 dB hybrid couplers in a frequency diplexer circuit.

This system, whose principle is well-known, includes two band-pass filters, one on each main wave guide, constituted by cavities 20, 22, 24 delimited by diaphragms 26, 28, 30, 32 and fitted with adjusting screws such as 34 which cause respective silica rods 36 to enter the cavity. These two filters are inserted between two −3 dB couplers C1 and C2 of the type already described.

Two frequency bands B1 and B2 enter a channel V1 which constitutes one of the main wave guides. The coupler C1 divides the energy into two equal parts. The band-pass filters tuned to B1 are transparent for the band B1 and the energy is recombined by means of C2 and leaves via the channel V4.

In constrast, the band B2 is reflected by the band-pass filters and due to the phase properties of the coupler C1, the energy of B2 leaves via the channel V2.

The angle of inclination of the coupling arms is 60°, i.e. A=30°.

The two filters are staggered by 1.42 mm to compensate for the phase differences caused by inclined arm couplers, the openings of the arms in one of the main wave guides being shifted by 2.08 mm in relation to the corresponding openings of the arms in the other main wave guide. It appears that the filters must always be shifted by less than the openings of the arms, but by more than half as much.

The band-pass filters can be replaced by high-pass or low-pass filters, according to the required system.

This type of diplexer can be used in filtering systems for circular wave guide sub-band connections in microwave beam systems or as power filters designed to connect the energy of several transmitters to a single aerial.

The inclined arm couplers in accordance with the invention make it possible to obtain exellent electric characteristics over wide frequency bands.

These couplers make it possible to obtain directivity of more than 30 dB in the 32 to 40 GHz frequency band with a standing wave ratio of less than 1.05 and insertion losses lower than 0.15 dB.

We claim:

1. A multiple branch-line wave guide coupler comprising:

a first main wave guide having a rectangular cross-section with two large surfaces along two large sides of the cross-section and two small surfaces along two small sides thereof, a second main wave guide of the same type as the first, positioned at a distance from the first and extending parallel thereto with a large surface facing a large surface of the first, and a plurality of coupling arms in the form of coupling wave guides with rectangular cross-sections each with a large side parallel to each other and substantially coextensive with the large sides of the cross-sections of the main wave guides, said arm extending parallel to each other between the two large surfaces which face each other of the two main wave guides and opening out at both their ends into the two main wave guides to couple these two wave guides together, the improvement wherein all of said coupling arms extend parallel to each other in the same direction and at an angle A of less than 90° to the direction of the main wave guides, all of said coupling arms comprising hollowed arms in a conductive surrounding material, and said coupling arms have a cross-section, the large side of which is substantially coextensive with the large side of the main guide cross-section.

2. A coupler according to claim 1, wherein the said angle A lies between 25° and 50°.

3. A coupler according to claim 1, wherein two conductive shells are assembled along a junction plane which passes through the centers of the large sides of the main wave guides and of the wave guides which form the coupling arms, said two shells being hollowed out from the junction plane to form the main wave guides and the coupling arms, each of these shells comprising:

a first half main wave guide;

a second half main wave guide parallel to the first and having the same width b and depth a/2 ; and a plurality of half coupling arms parallel to one another having the same length k and forming said angle A with the main half-arms; and wherein the sine of said angle A is less than the expression $2b/(a-k)$.

4. A diplexer comprising:

a first main wave guide of rectangular cross-section with two large surfaces along two large sides of the cross-section and two small surfaces along two small sides;

a second main wave guide of the same type as the first, positioned at a distance from the first and extending parallel thereto with a large surface facing a large surface of the first main wave guide; and two half-energy couplers each having a plurality of coupling arms in the form of wave guides which extend parallel to one another between the two facing surfaces of the two main wave guides, each of these arms opening out at both its ends into the two main wave guides to couple said two wave guides together and, on each main wave guide, a frequency filter disposed between the both couplers; and wherein the coupling arms extend in one direction which forms an angle A of less than 90° with the direction of the main wave guides, so as to shift the openings of each of these arms in the two main wave guides relative to each other;

said angle being the same with an inclination in the same direction for both couplers; and both of the frequency filters being disposed on the main wave guides and being relatively shifted in the same direction as are the openings of the arms and by a magnitude lying between 50% and 100% of the magnitude of the shift of the openings.

5. A diplexer according to claim 4, wherein two conductive shells are assembled along a junction plane which passes through the centers of the large sides of the main wave guides and of the wave guides which form the coupling arms, these two shells being hollowed out from the junction plane to form the main wave guides and the coupling arms, each of these shells comprising:

a first half main wave guide;

a second half main wave guide parallel to the first and having the same width b and depth a/2; and a plurality of half coupling arms parallel to one another having the same length k and forming said angle A with the main half-arms; wherein the sine of this angle A is less than the expression $2b/(a-k)$.

* * * * *